US008351804B2

(12) United States Patent
Birumachi

(10) Patent No.: US 8,351,804 B2
(45) Date of Patent: Jan. 8, 2013

(54) FIXING APPARATUS

(75) Inventor: Takashi Birumachi, Kashiwa (JP)

(73) Assignee: Canon Kabushiki Kaisha (JP)

( * ) Notice: Subject to any disclaimer, the term of this patent is extended or adjusted under 35 U.S.C. 154(b) by 311 days.

(21) Appl. No.: 12/881,585

(22) Filed: Sep. 14, 2010

(65) Prior Publication Data

US 2011/0097093 A1 Apr. 28, 2011

(30) Foreign Application Priority Data

Oct. 22, 2009 (JP) ..... 2009-243204

(51) Int. Cl.
*G03G 15/00* (2006.01)
*G03G 15/20* (2006.01)

(52) U.S. Cl. ..... 399/21; 399/33; 399/36; 399/67; 399/322; 399/400

(58) Field of Classification Search ..... 399/21, 399/22, 33, 36, 67, 68, 322, 323, 400
See application file for complete search history.

(56) References Cited

U.S. PATENT DOCUMENTS

| | | | | |
|---|---|---|---|---|
| 6,757,502 | B2 * | 6/2004 | Yoshikawa | 399/22 |
| 7,110,689 | B2 | 9/2006 | Takahashi | |
| 7,113,717 | B2 * | 9/2006 | Bott et al. | 399/67 |
| 7,742,732 | B2 * | 6/2010 | Amico et al. | 399/328 |
| 2004/0247333 | A1 | 12/2004 | Takahashi | |

FOREIGN PATENT DOCUMENTS

| | | | |
|---|---|---|---|
| JP | 11-194647 | A | 7/1999 |
| JP | 2004-354983 | A | 12/2004 |

* cited by examiner

*Primary Examiner* — Joseph S Wong
(74) *Attorney, Agent, or Firm* — Rossi, Kimms & McDowell LLP

(57) ABSTRACT

A fixing apparatus capable of performing, even by a short brake, brake assist by which a sheet is stopped at a position where the sheet is visible. Upon occurrence of a wrap jam, brake control for a drive motor and brake assist control are performed. In the brake assist control, a pressing process is performed based on the number of assist operation pulses, which is set in advance. When an edge of a home position sensor signal is detected, a process for stopping the pressing process is carried out, whereby a pressing unit assumes a maximum pressing position.

7 Claims, 13 Drawing Sheets

FIXING APPARATUS

BACKGROUND OF THE INVENTION

1. Field of the Invention

The present invention relates to a fixing apparatus for applying heat to an image formed on a sheet conveyed to a nip portion of the apparatus, thereby fixing the image onto the sheet.

2. Description of the Related Art

In an image forming apparatus such as an electrophotographic apparatus and an electrostatic recording apparatus, a toner image is formed on a recording sheet, and heat and pressure are applied to the toner image by a fixing apparatus, whereby the toner image is fixed onto the sheet.

Conventionally, as such a fixing apparatus, a roller fixing type apparatus and a belt fixing type apparatus have been used (see, Japanese Laid-open Patent Publication No. 11-194647).

In a copying machine having a fixing apparatus of these types, there can occur an abnormality such that a recording sheet is wrapped around a fixing apparatus component at the time of toner melting, irrespective of whether the fixing apparatus is of a roller fixing type or a belt fixing type. Especially, in the case of a thin recording sheet or a recording sheet which is not thin but limp, the wrapped recording sheet becomes inseparably affixed to a roller surface or between belt surfaces due to molten toner.

If such a phenomenon occurs, the wrapped recording sheet is exposed to high temperature environment. It is therefore demanded, from the viewpoint of apparatus safety, that a notification of occurrence of the phenomenon be immediately displayed and the recording sheet in the fixing apparatus be visible so as to be removable from the apparatus without fail.

Heretofore, the fixing apparatus has been configured to have sensors for detecting sheet conveyance timings, which are disposed at the entrance and exit of the apparatus, and timings of a recording sheet being conveyed into and out from the apparatus are monitored by using these sensors. If the recording sheet is not discharged from the fixing apparatus before the lapse of a predetermined time from when the sheet was conveyed into the apparatus, a drive motor performs a braking operation to immediately stop the sheet conveyance (see, for example, Japanese Laid-open Patent Publication No. 2004-354983).

As the drive motor for the fixing apparatus, a brushless DC motor is generally used, which is long in service life and high in speed and torque, and either a so-called short brake method or a so-called reverse brake method is used for the braking operation.

The short brake method causes motor windings of respective phases to be short-circuited to perform a braking operation by a torque generated through electromagnetic induction, while consuming rotational energy through the resistance of the motor windings. On the other hand, the reverse brake method performs a braking operation by controlling winding currents by means of semiconductor devices so that a reverse rotational torque is generated (see, Koji Ogino, How to use brushless DC motor, Ohmsha, Ltd., P103).

A required braking time can be made shorter in the reverse brake method than in the short brake method. With the reverse brake method, however, the power supply voltage increases due to winding currents being regenerated to the power supply, and therefore, circuit components (such as semiconductor switching devices and electrolytic capacitors) must have higher withstand voltages. If the braking time is not properly controlled, a problem is posed, for example, that the braking time becomes excessively long to an extent that the drive motor reversely rotates.

In the belt fixing type fixing apparatus, the motor rotation speed and speed reduction ratio are made large or the size of motor rotor is made large in order to increase the drive motor output.

However, an increased motor rotation speed results in an increase of deceleration time in the short brake method, and an increased rotor size results in an increase of the inertia moment of the rotor and an increase of deceleration time in the reverse brake method.

Therefore, in an image forming apparatus mounted with a belt fixing type fixing apparatus, a braking operation by the low-priced short brake method cannot stop a recording sheet at a position where the sheet is visible for removal when the sheet is wrapped around a fixing apparatus component.

In a belt fixing type fixing apparatus, a change in belt tension causes a change in radius of curvature of a belt at the drive roller, thereby affecting the service life of the belt. Thus, the affect of brake on the belt tension must be reduced as small as possible.

SUMMARY OF THE INVENTION

The present invention provides a fixing apparatus capable of performing a brake assist operation by which a sheet is stopped at a position where the sheet is visible, even by using a low-priced short brake which less affects the required performance of circuit components.

According to a first aspect of the present invention, there is provided a fixing apparatus that conveys a sheet formed with an image to a nip portion and fixes the image onto the sheet at the nip portion, the nip portion being formed by a roller driven by a motor and a pressing device for being pressed against the roller, which comprises a conveyance abnormality detection unit configured to detect a sheet conveyance abnormality in the nip portion, and a brake control unit configured to brake the motor and increase a pressing amount of the pressing device so as to assist braking of the motor in a case where a sheet conveyance abnormality is detected.

According to a second aspect of the present invention, there is provided a fixing apparatus that conveys a sheet formed with an image to a nip portion and fixes the image onto the sheet at the nip portion, the nip portion being formed by a roller driven by a motor and a pressing device for being pressed against the roller, which comprises a detection unit configured to detect that a sheet is wrapped around the roller, and a brake control unit configured to brake the motor and increase a pressing amount of the pressing device so as to assist braking of the motor in a case where the detection unit detects that a sheet is wrapped around the roller.

With the fixing apparatus of this invention, when it is detected that there is a delay in sheet conveyance to the nip portion, the motor is braked and the pressing amount of the pressing unit is increased to assist the braking of the motor, thereby making it possible to carry out a brake assist operation by which the sheet can be stopped at a position where the sheet is sufficiently visible, even by means of a low-priced short brake, which less affects the required performance (e.g., withstand voltages) of circuit components.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
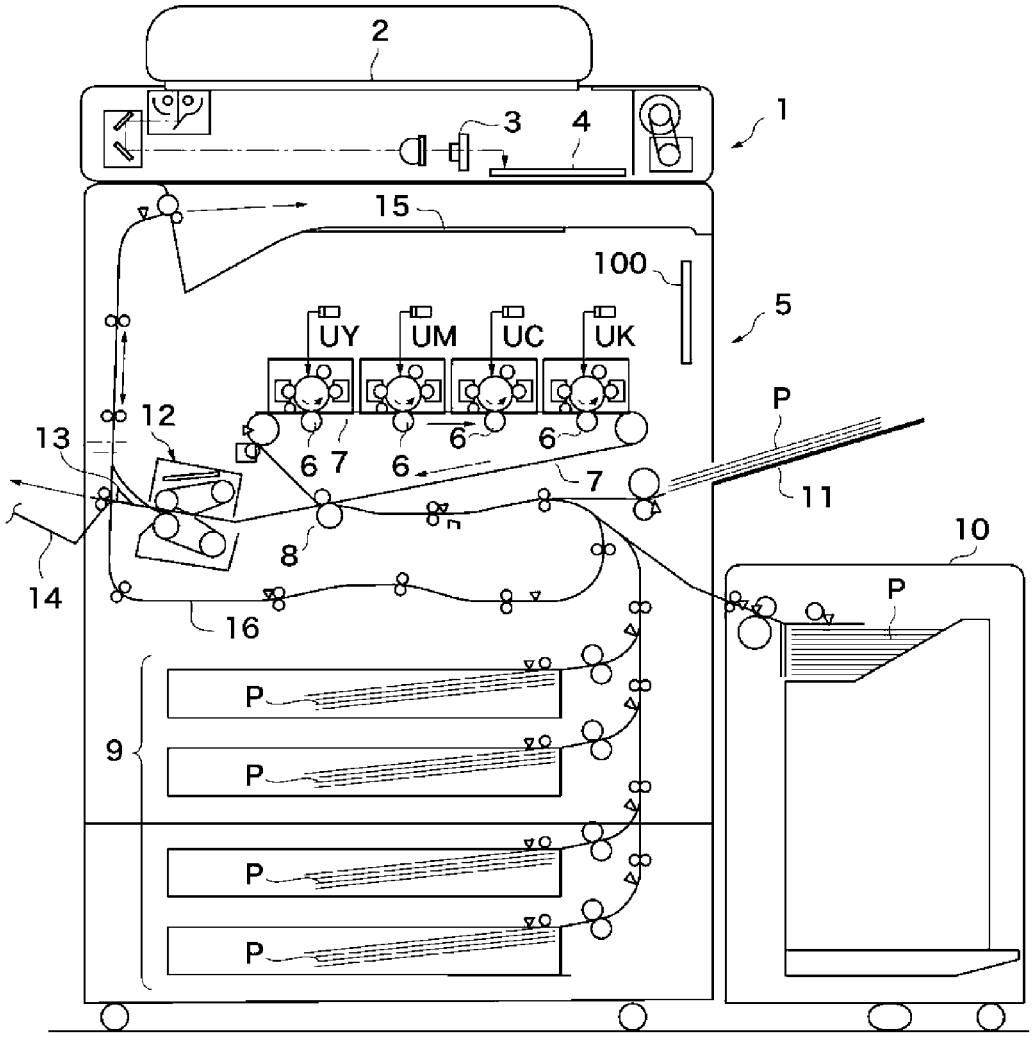
FIG. 1 is a vertical section view schematically showing the construction of a full-color electrographic copying machine, which is an example of an image forming apparatus mounted with a belt fixing type fixing apparatus according to one embodiment of this invention.

FIG. 1 schematically shows in vertical section the construction of a full-color electrographic copying machine, which is an example of an image forming apparatus mounted with a belt fixing type fixing apparatus according to one embodiment of this invention. The copying machine includes a digital color image reader unit 1 and a digital color image printer unit 5.

The reader unit 1 includes a full color sensor (CCD) 3 that reads an image of a color image original placed on an original table glass 2 and obtains a color-separated image signal representing the read image. The image signal is processed by an image processing unit 4 and then supplied to a control circuit unit (hereinafter, referred to as the CPU) 100 of the printer unit 5.

The digital color image printer unit 5 includes first to fourth image forming units UY, UM, UC, and UK, which are disposed in tandem. The image forming units each include an electrophotographic process mechanism of a laser exposure type. Based on the color-separated image signal supplied from the image processing unit 4 to the CPU 100 of the printer unit 5, respective color toner images are formed at predetermined control timings on surfaces of rotating photosensitive drums of the image forming units.

Specifically, a yellow toner image is formed by the first image forming unit UY, a magenta toner image is formed by the second image forming unit UM, a cyan toner image is formed by the third image forming unit UC, and a black toner image is formed by the fourth image forming unit UK. It should be noted that since the electrophotographic process mechanism of each image forming unit and its image forming operation are well known, a description thereof is omitted.

The toner images of respective colors formed by the image forming units are sequentially transferred by primary transfer devices 6 onto an intermediate transfer belt 7 that rotates clockwise, so as to be superimposed one upon another, whereby an unfixed full color toner image is formed on the intermediate transfer belt 7.

Subsequently, the full-color toner image is secondary-transferred at a secondary transfer device 8 onto a recording material P, which is fed at a predetermined timing from a cassette type sheet feed mechanism 9, a sheet feed deck 10, or a manual sheet feeder 11.

The recording material P is then separated from the intermediate transfer belt 7 and introduced into a fixing apparatus 12 where the recording material P is held and conveyed by a fixing nip portion of the fixing apparatus 12. During the course of the recording material P being held and conveyed in the fixing apparatus 12, the unfixed full-color toner image is caused to melt by heat and pressure so that the image is color-mixed and fixed onto a surface of the recording material P.

The recording material P is conveyed out from the fixing apparatus 12 and discharged to either a FU (faceup) sheet discharge tray 14 or a FD (facedown) sheet discharge tray 15, with a sheet conveyance path switched by a flapper 13, whereupon a series of image forming operations is completed.

If a double-sided print mode is selected, the recording material P having passed the fixing device 12 is fed via the flapper 13 to a sheet conveyance path communicating with the sheet discharge tray 15, and then switch-back conveyed to a sheet conveyance path 16, whereupon the recording material P is again introduced into the secondary transfer device 8 in a state it is reversed front to back.

In the secondary transfer device 8, a toner image is secondary-transferred onto a second surface of the recording material P. Subsequently, the recording material P is introduced into the fixing apparatus 12 where the toner image is fixed to the second surface of the recording material. Then, the recording material P is discharged to the FU sheet discharge tray 14 or the FD sheet discharge tray 15.

Figure 2:
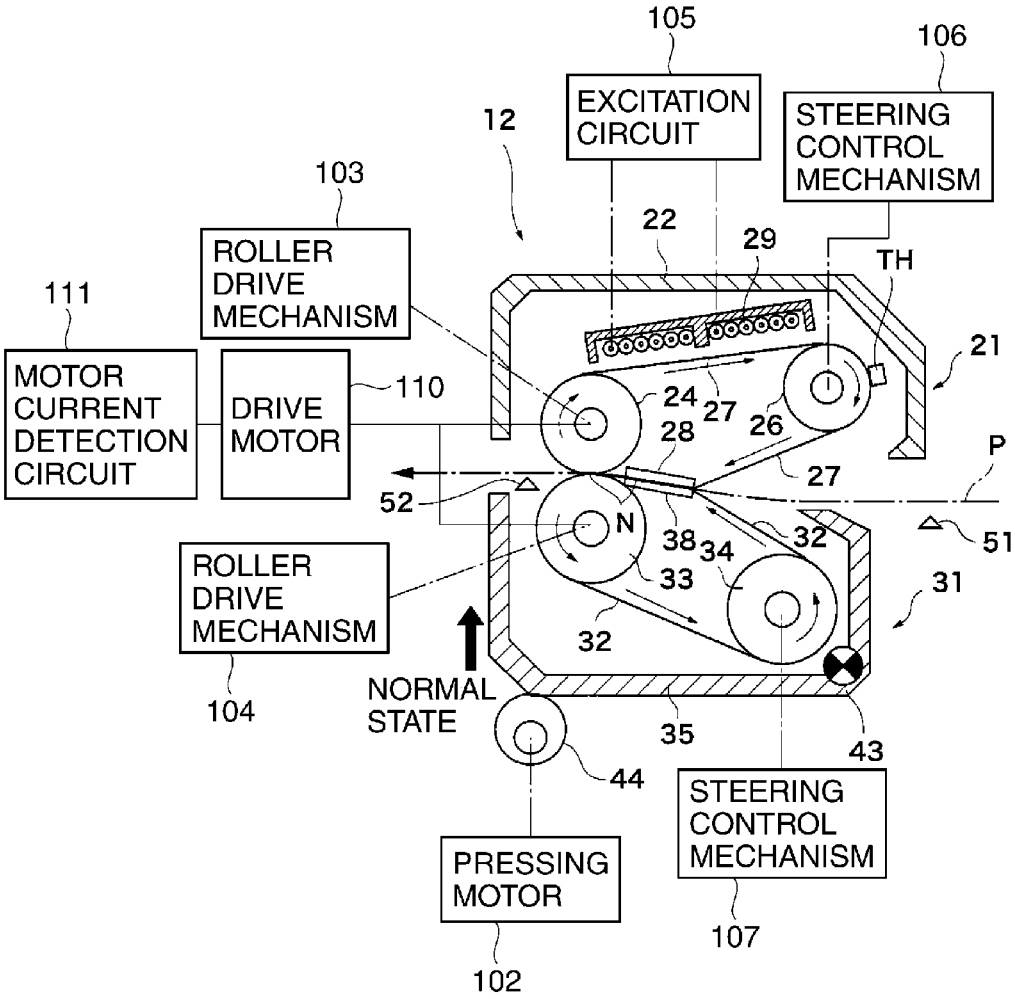
FIG. 2 is a section view showing the construction of the belt fixing type fixing apparatus in a normal state.
Figure 3:
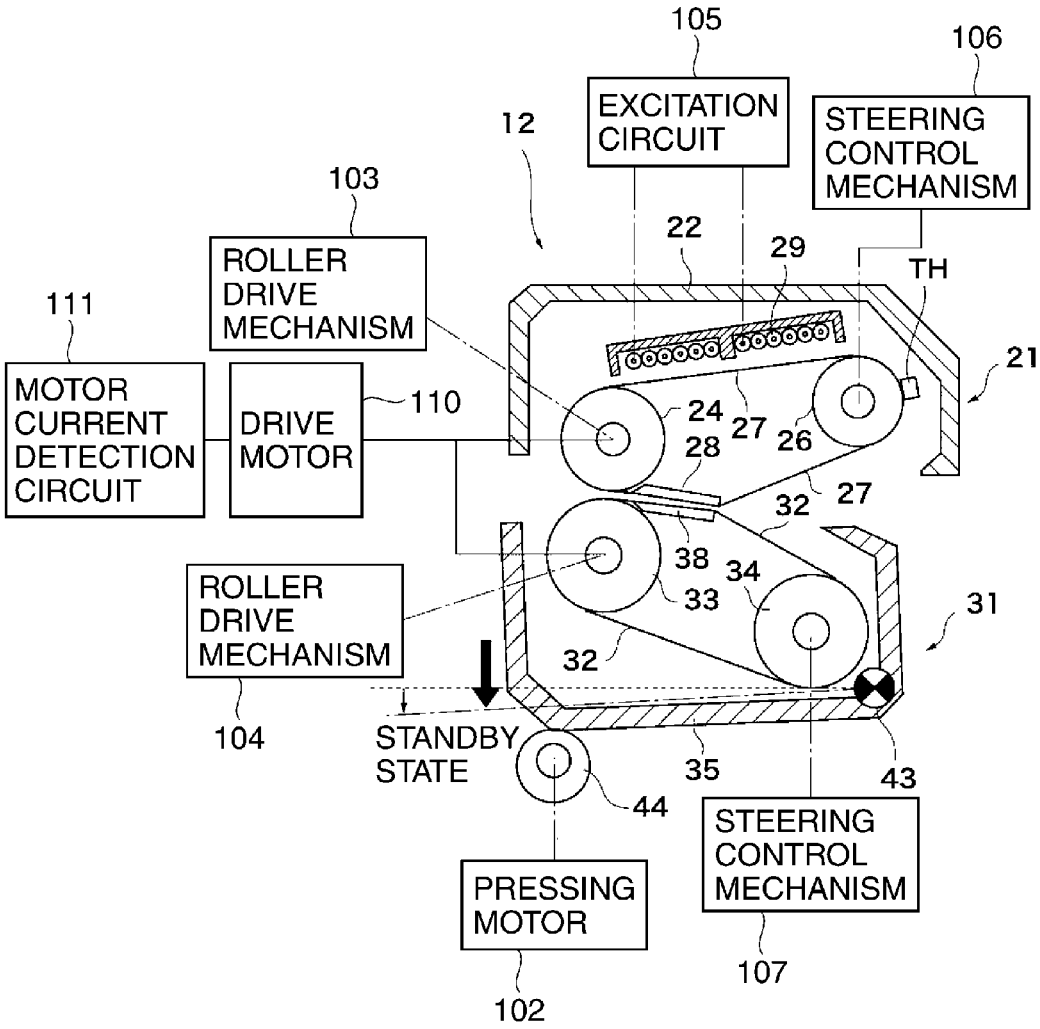
FIG. 3 is a section view showing the construction of the belt fixing type fixing apparatus in a standby state.

FIGS. 2 and 3 show in section view the construction of the belt fixing type fixing apparatus 12 in a normal state and the apparatus construction in a standby state, respectively. The fixing apparatus 12 includes a twin-belt type belt conveyance unit having first and second endless belts which are rotatably disposed in press contact with each other.

In the following description of the fixing apparatus 12, the term "front" refers to a front side (i.e., a recording material entrance side) of the fixing apparatus, and the terms "left and right" refer to left and right sides of the fixing apparatus as seen from the front side thereof. The terms "upstream side and downstream sides" refer to upstream and downstream sides as viewed in the direction of conveyance of recording material. The term "width direction" refers to a direction perpendicular to the direction of conveyance of recording material, and the term "width" refers to a size as viewed in the width direction.

The fixing apparatus 12 includes a fixing unit 21 and a pressing unit 31, which are disposed on upper and lower sides of the fixing apparatus 12, respectively. The fixing unit 21 is an assembly that includes a casing 22 in which there are incorporated a fixing belt 27 (as the first endless belt), drive roller 24, steering roller 26, pressing pad 28, and induction heating coil 29.

The drive roller 24 has a function of suspending and rotatably driving the fixing belt 27. Left and right shaft portions of the drive roller 24 are rotatably supported by bearings provided at left and right side plates of the casing 22.

The steering roller 26 has a function of rotatably supporting the fixing belt 27 and controlling the position of the fixing belt 27 in the width direction. Left and right shaft portions of the steering roller 26 are rotatably supported by bearings provided at the left and right side plates of the casing 22.

The fixing belt 27 is stretched between the drive roller 24 and the steering roller 26 and heated by electromagnetic induction by the induction heating coil 29. The fixing belt 27 has a belt base layer and a silicon rubber layer. The belt base layer is formed by a magnetic metal layer such as a nickel metal layer or a stainless layer and has a thickness of 75 μm, a width of 380 mm, and a circumferential length of 200 mm, for instance. The silicon rubber layer has a thickness of, e.g., 300 μm and is coated on an outer surface of the belt base layer.

The pressing pad 28 is disposed in contact with an inner surface of the fixing belt 27 and supported at its left and right end portions by the left and right side plates of the casing 22. The pressing pad 28 is disposed near the drive roller 24 and has a function of pressing the fixing belt 27 toward the pressing belt 32 from inside of the belt 27.

The induction heating coil 29, which is a combination of an oval flat-wound litz coil and a plate-like magnetic core, is disposed to face via a gap an outer surface of the fixing belt 27 and supported by the casing 22.

The pressing unit 31 is an assembly that includes a casing 35 in which there are incorporated a pressing belt 32 (as the second endless belt), drive roller 33, steering roller 34, and pressing pad 38.

The drive roller 33 has a function of suspending and rotatably driving the pressing belt 32. Left and right shaft portions of the drive roller 33 are rotatably supported by bearings provided at left and right side plates of the casing 35.

The steering roller 34 has a function of rotatably supporting the pressing belt 32 and controlling the position of the belt 32 in the width direction. Left and right shaft portions of the steering roller 34 are rotatably supported by bearings provided at the left and right side plates of the casing 35. The pressing belt 32 is stretched between the drive roller 33 and the steering roller 34.

The pressing pad 38 is disposed in contact with an inner surface of the pressing belt 32, and left and right end portions of the pressing pad 38 are supported by the left and right side plates of the casing 35. The pressing pad 38 is disposed near the drive roller 33 and has a function of pressing the pressing belt 32 toward the fixing belt 27 from inside of the belt 32.

The pressing unit 31 is pivotable about a pivot shaft 43 in a vertical direction and supported such that a lower surface of the casing 35 is in abutment with an eccentric cam 44. The eccentric cam 44 is driven half-turn by a pivot mechanism, which is in turn driven by a pressing motor 102, so that the eccentric cam 44 is switched between a first rotation angle position where a large radius cam portion is directed upward and a second rotation angle position where a small radius cam portion is directed upward.

When the eccentric cam 44 is switched to the first rotation angle position, the pressing unit 31 is moved upward about the pivot shaft 43, whereby the pressing belt 32 and the fixing belt 27 are held between the drive rollers 33, 28 of the pressing unit 31 and the fixing unit 21 and held between the pressing pads 38, 28 of the pressing unit 31 and the fixing unit 21, as shown in FIG. 2.

When the fixing unit 21 and the pressing unit 31 are in a normal state shown in FIG. 2, the fixing belt 27 and the pressing belt 32 are pressed against each other at a portion extending along the drive rollers 24, 33 and the pressing pads 28, 38, whereby a fixing nip portion N having a wide width and extending in the direction of conveyance of recording material is formed. In the normal state, a fixing operation can be carried out.

The fixing belt 27 of the fixing unit 21 is an endless belt for heating an image on a recording material located at the nip portion. The pressing belt 32 of the pressing unit 31 is another endless belt rotatably disposed in press contact with the fixing belt 27 to cooperate with the fixing belt 27 to form the nip portion.

When the eccentric cam 44 is switched to the second rotation angle position, the pressing unit 31 is moved downward about the pivot shaft 43, whereby the pressing of the drive roller 24 by the drive roller 33 is released, and the pressing of the pressing pad 28 by the pressing pad 38 is also released. As a result, a standby state shown in FIG. 3 where the pressing belt 32 is spaced apart from the fixing belt 27 is attained.

When the fixing unit 21 and the pressing unit 31 are in the standby state shown in FIG. 3, a fixing operation cannot be carried out.

To operate the fixing apparatus 12 such that a recording material is held and conveyed by the fixing nip portion, the eccentric cam 44 is switched to the first rotation angle position by the pivot mechanism, which is driven by the pressing motor 102 under the control of the CPU 100, whereby the fixing unit 21 and the pressing unit 31 are held in the normal state.

To disable the operation of the fixing apparatus 12 so that a recording material is not held nor conveyed by the fixing nip portion, the eccentric cam 44 is switched to the second rotation angle position by the pivot mechanism under the control of the CPU 100, whereby the fixing unit 21 and the pressing unit 31 are held in the standby state in which undesired pressure is prevented from being applied between the fixing unit 21 and the pressing unit 31 and relevant parts are prevented from being worn.

Roller drive mechanisms 103, 104 for driving the drive rollers 24, 33 are coupled to and driven by a drive motor 110 via a transmission mechanism (not shown) such as gears.

To operate the fixing apparatus 12, the CPU 100 turns on a drive control signal of the drive motor 110, whereby the drive motor 110 starts rotating so that the roller drive mechanisms 103, 104 are started to be driven.

The drive rollers 24, 33 rotate at predetermined speeds in opposite directions. The fixing belt 27 rotates clockwise with rotation of the drive roller 24, and the pressing belt 32 rotates anticlockwise with rotation of the drive roller 33, as shown by arrows in FIG. 2.

Peripheral speeds of the drive rollers 24, 33 are set such that the rotation speed of the fixing belt 27 becomes substantially equal to that of the pressing belt 32.

The input current of the drive motor 110 is always detected by a motor current detection circuit 111. When the motor input current equal to or greater than a predetermined value is detected, a protection operation is carried out.

The CPU 100 turns on an excitation circuit 105 to thereby supply a high frequency current to the induction heating coil 29. The metal layer of the fixing belt 27 generates heat by electromagnetic induction, whereby the fixing belt 27 is heated.

A surface temperature of the fixing belt 27 is detected by a temperature detecting element such as a thermistor (denoted by symbol TH in FIGS. 2 and 3), and temperature information representing the surface temperature of the fixing belt 27 is input to the CPU 100. Based on the temperature information, the CPU 100 controls the power supply from the excitation circuit 105 to the induction heating coil 29 to make the temperature of the fixing belt 27 equal to a predetermined fixing temperature.

In a state where the temperature of the fixing belt 27 is controlled to the predetermined fixing temperature, a recording sheet P on which an unfixed toner image is carried is introduced from the secondary transfer unit 8 to the fixing apparatus 12, with an image-carrying surface of the recording sheet P directed to the fixing belt 27.

The recording sheet P is held and conveyed by the fixing nip portion N where the fixing belt 27 and the pressing belt 32 are pressed against each other, whereby the unfixed toner image is fixed by heat and pressure onto the recording sheet P. To this end, the fixing belt 27 is arranged to be in contact with the image-carrying surface of the recording sheet P at the fixing nip portion and heat the image carried on the image-carrying surface of the sheet.

Figure 4:
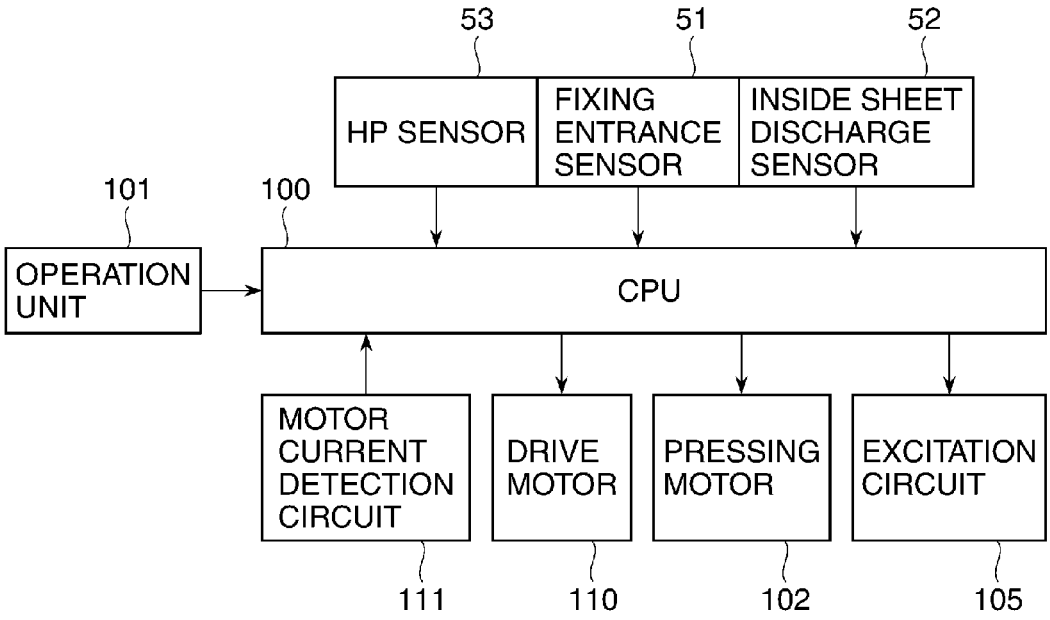
FIG. 4 is a block diagram showing the construction of a control system of the image forming apparatus mounted with the fixing apparatus.

FIG. 4 shows in block diagram the construction of a control system of the image forming apparatus mounted with the fixing apparatus. The control system includes the CPU 100 to which there are connected an operation unit 101, motor current detection circuit 111, drive motor 110, pressing motor 102, excitation circuit 105, and various sensors including a home position (HP) sensor 53, fixing entrance sensor 51, and inside sheet discharge sensor 52.

The CPU 100 controls the entire image forming apparatus. The operation unit 101 includes a liquid crystal touch panel, buttons, and the like. Under the control of the CPU 100, the image forming apparatus starts operating in response to a user's input from the operation unit 101.

The CPU 100 controls the pivot mechanism (driven by the pressing motor 102), roller drive mechanisms 103, 104, excitation circuit 105, steering control mechanisms 106, 107, drive motor 110, and the like.

Based on temperature information input from the temperature detecting element TH, the CPU 100 controls the power supply from the excitation circuit 105 to the induction heating coil 29.

Next, a description will be given of a pressing process performed in a copying operation by the image forming apparatus having the above construction.

Figure 5:
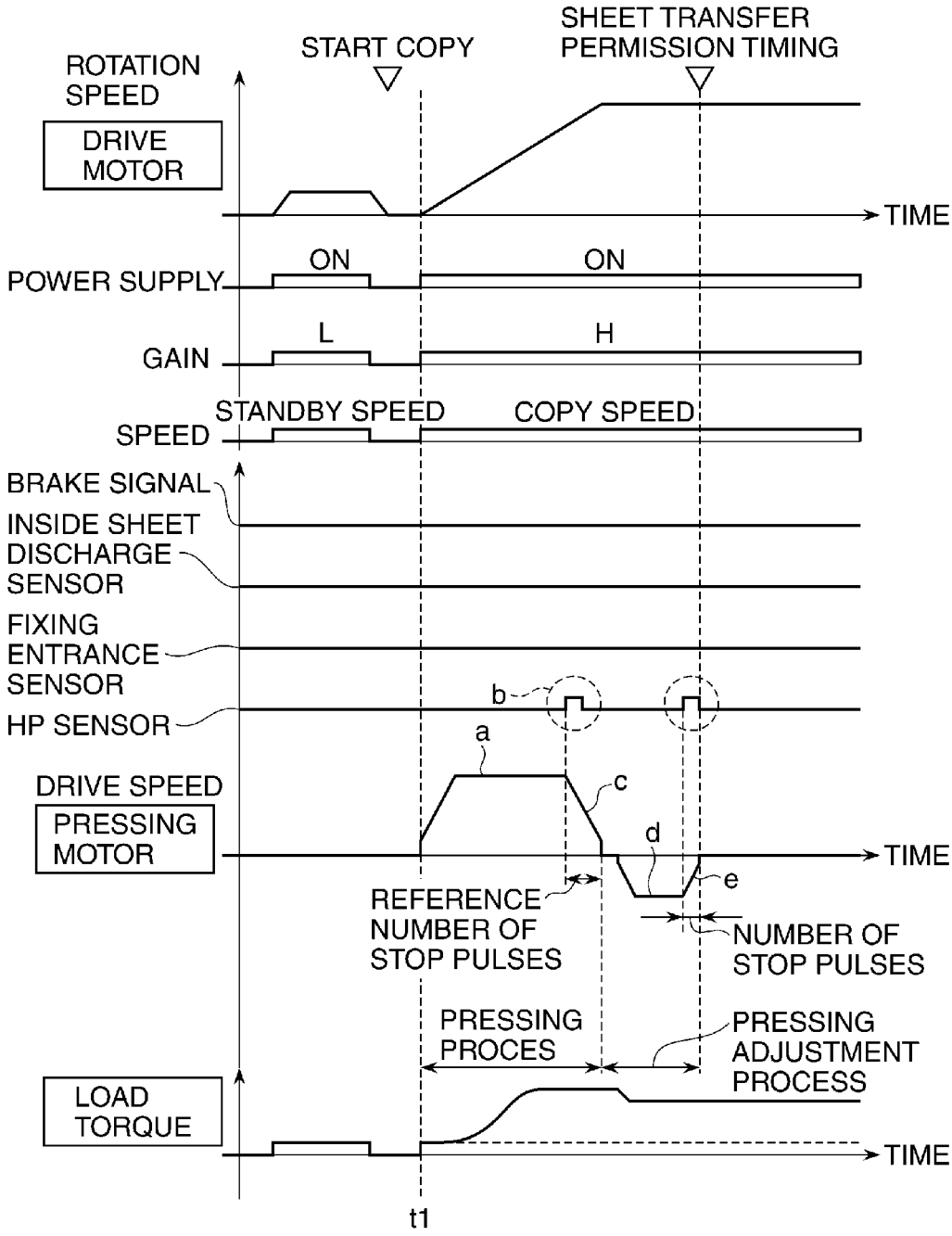
FIG. 5 is a timing chart showing a pressing process in a copying operation.

FIG. 5 shows a timing chart of a pressing process in a copying operation. When the image forming apparatus starts the copying operation at a time point of t1 in response to a user's input from the operation unit 101, the fixing apparatus 12 starts driving the drive motor 110 (serving as the drive source of the roller drive mechanisms 103, 104). At the same time, the fixing apparatus starts driving the pressing motor 102 to thereby start the pressing process to move the pressing unit 31 to a predetermined pressing position in the normal state.

Figure 6:
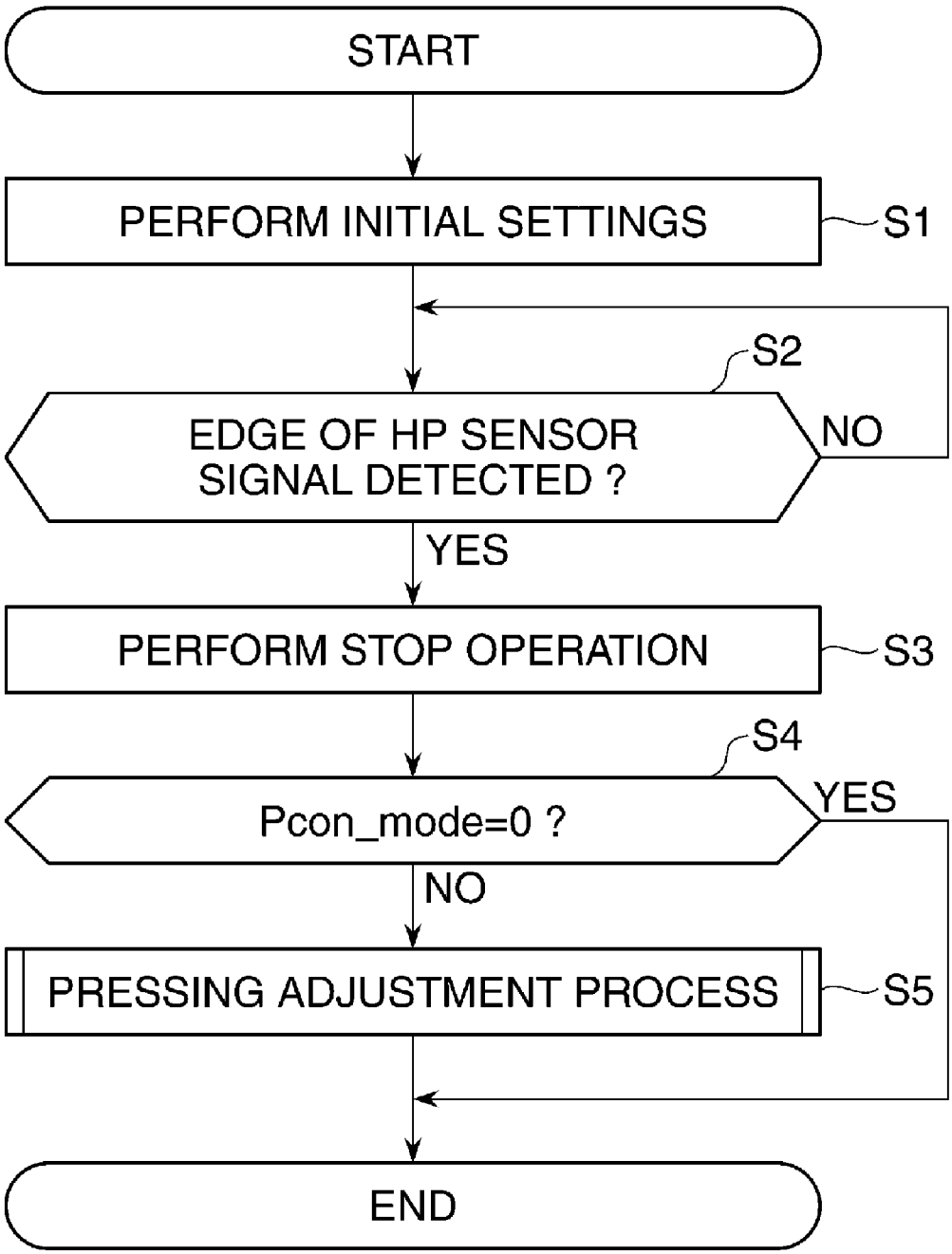
FIG. 6 is a flowchart showing the procedures of the pressing process.

FIG. 6 is a flowchart showing the procedures of the pressing process. A control program is stored in a storage device of the CPU 100 and executed by the CPU 100.

The CPU 100 performs initial settings of a driver for the pressing motor 102 so as to attain a trapezoidal drive speed profile as shown by symbol a in FIG. 5, and starts driving the pressing motor 102 (step S1). A speed ratio Vs/Vr, acceleration α, and a reference number of stop pulses "Pls_stp_ref" are set in the initial settings. Based on a pulse command given to the driver, the pressing motor 102 (which is a stepping motor) is driven while the speed and position of the motor being controlled.

Next, the CPU 100 monitors a signal which is input from the HP sensor 53 for reference position detection (hereinafter, referred to as the HP sensor signal) (step S2). When it is confirmed that the HP sensor signal changes as shown by symbol b in FIG. 5 (when a rising edge of the HP sensor signal is detected in this example), the CPU 100 starts decelerating as shown by symbol c in FIG. 5 to make a stop operation based on the predetermined reference number of stop pulses "Pls_stp_ref" so that the pressing motor 102 (pressing unit 31) will be stopped at the reference position (step S3).

Next, the CPU 100 confirms a pressing adjustment mode register value "Pcon_mode" to determine, based on the type of recording sheet (pressing adjustment mode) used in the image forming apparatus, whether a pressing adjustment process should be made (step S4).

As the pressing adjustment mode register value "Peon mode," a value that varies according to the type of recording sheet is set. For example, a value of 1 is set for normal sheet, a value of 1 is set for thick sheet, and a value of 2 is set for thin sheet. To this end, the type of recording sheet stored in a sheet storage unit can automatically be determined by the image forming apparatus. Alternatively, the type of recording sheet can be set by a user via the operation unit.

If the pressing adjustment mode register value "Pcon_mode" is equal to 0 (representing normal sheet in this example), the present process is completed without performing the pressing adjustment process.

On the other hand, if the pressing adjustment mode register value "Pcon_mode" is not equal to 0, the CPU 100 performs the pressing adjustment process according to the type of recording sheet (i.e., register value) and the number of stop pulses for the pressing adjustment process (step S5), whereupon the present process is completed.

Figure 7:
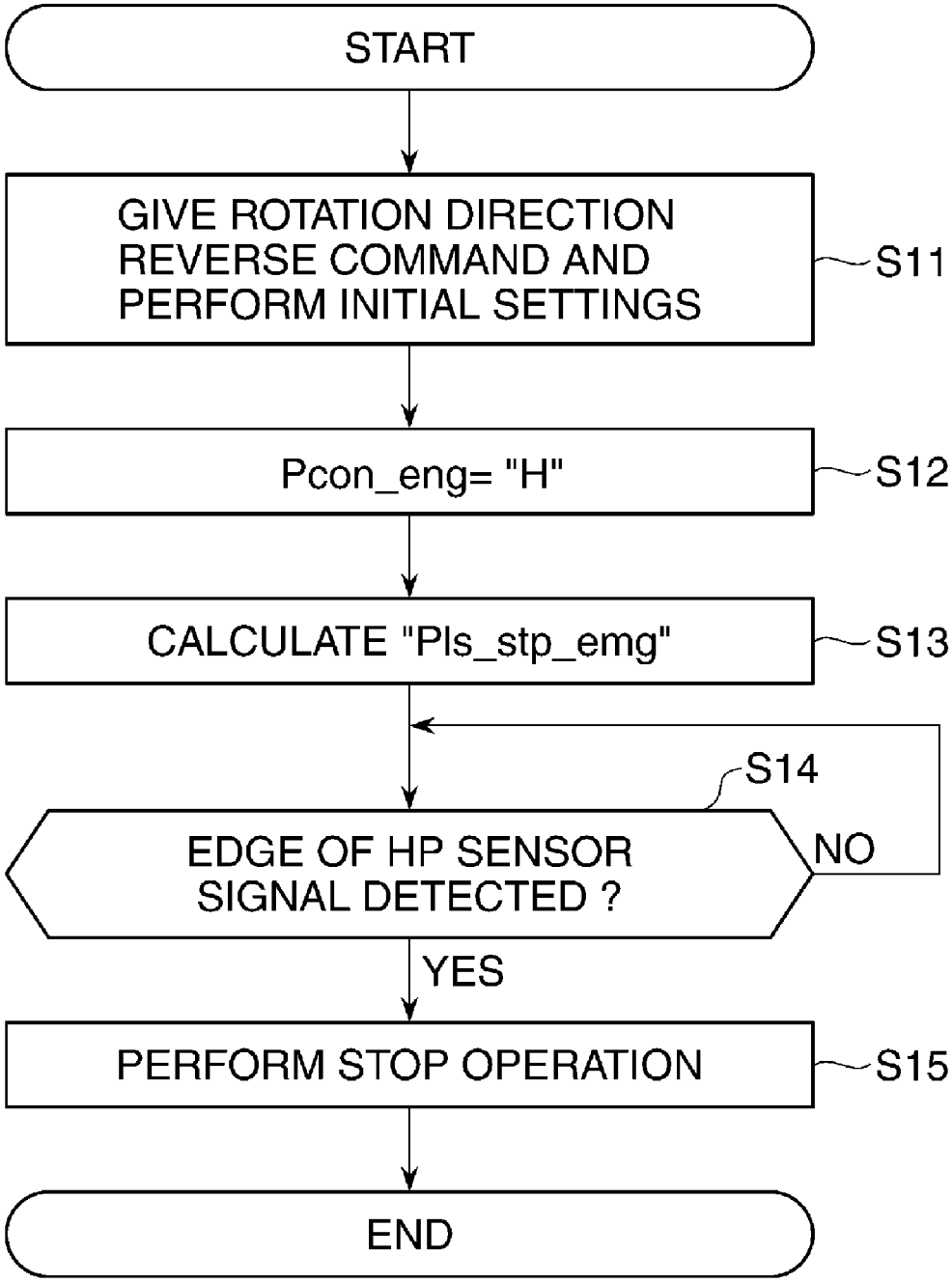
FIG. 7 is a flowchart showing the procedures of a pressing adjustment process in step S5 in FIG. 6.

FIG. 7 shows in flowchart the procedures of the pressing adjustment process in step S5 in FIG. 6. The pressing adjustment process is the same as the pressing process except that the drive motor is driven to rotate in a direction opposite to that in the pressing process.

The CPU 100 gives a rotation direction reverse command to the driver for the pressing motor 102 and performs initial settings of the driver so as to attain a trapezoidal drive speed profile as shown by symbol d in FIG. 5 (step S11). In the initial settings, a speed ratio Vs/Vr, acceleration α, and the number of stop pulses "Pls_stp_comp" in the pressing adjustment process are set.

Next, the CPU 100 sets a pressing adjustment operation register value "Pcon_eng" to a value of 1 (H level) that represents a pressing adjustment mode (step S12). The register value "Pcon_eng" is used for a pressing amount readjustment in a brake assist control process at occurrence of fixing wrap jam.

In accordance with the following formula (1), the CPU 100 calculates the number of stop pulses "Pls_stp_emg" for the pressing amount readjustment (step S13).

$$\text{Number of stop pulses "}\textit{Pls_stp_emg}\text{"} = \text{Maximum number of stop pulses "}\textit{Pls_stp}_\text{max"} - \text{Return amount "}\textit{Pls_stp_cmp}\text{"} \quad (1)$$

It should be noted that the return amount "Pls_stp_cmp" is the number of stop pulses set in step S11, and is used as a pressing adjustment amount at occurrence of fixing wrap jam. In step S13, the CPU 100 starts a pressing adjustment.

Next, the CPU 100 monitors the HP sensor signal for reference position detection (step S14). When determining that the HP sensor signal changes, the CPU 100 performs a stop operation based on a predetermined number of stop pulses, as shown by symbol e in FIG. 5, to stop the pressing motor 102 (pressing unit 31) at a predetermined position (step S15). The present process is then completed and the flow returns to the pressing process.

Figure 8:
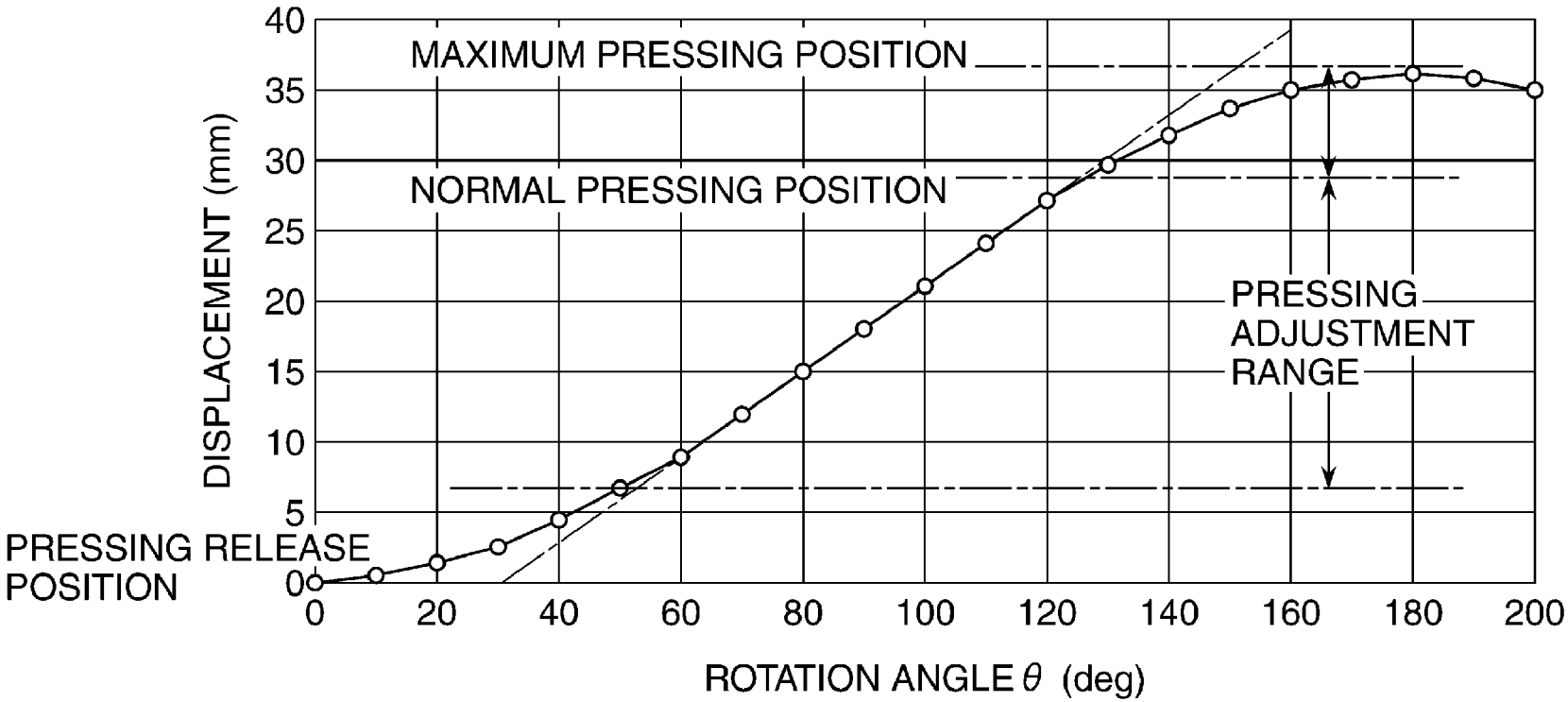
FIG. 8 is a graph showing a relation between a drive amount (rotation angle θ) of a pressing motor and a displacement amount of a pressing unit.

FIG. 8 is a graph showing a relation between a drive amount (rotation angle θ) of the pressing motor 102 and a displacement amount of the pressing unit 31 by the eccentric cam 44. The displacement amount of the pressing unit 31 is nearly in proportion to a pressing amount at the nip portion.

The relation shown in FIG. 8 between the rotation angle of the pressing motor 102 and the displacement amount of the pressing unit 31 is used for a case where the eccentric cam 44 has a complete round shaped cam profile. Since the relation between eccentric cam displacement and angle is represented by a sinusoidal wave, a pressing adjustment range is set so that linearization is valid therein.

As shown in FIG. 8, the pressing adjustment range is set to have an upper limit value near the normal pressing position (represented by the reference number of stop pulses "Pls_stp_ref"), i.e., near an upper limit of a range where the displacement amount of the pressing unit changes linearly with the change of rotation angle of the pressing motor. A pressing adjustment range at the time of brake assist is set to have an upper limit value near a maximum cam displacement position (represented by the maximum number of stop pulses "Pls_stp_max").

Figure 9:
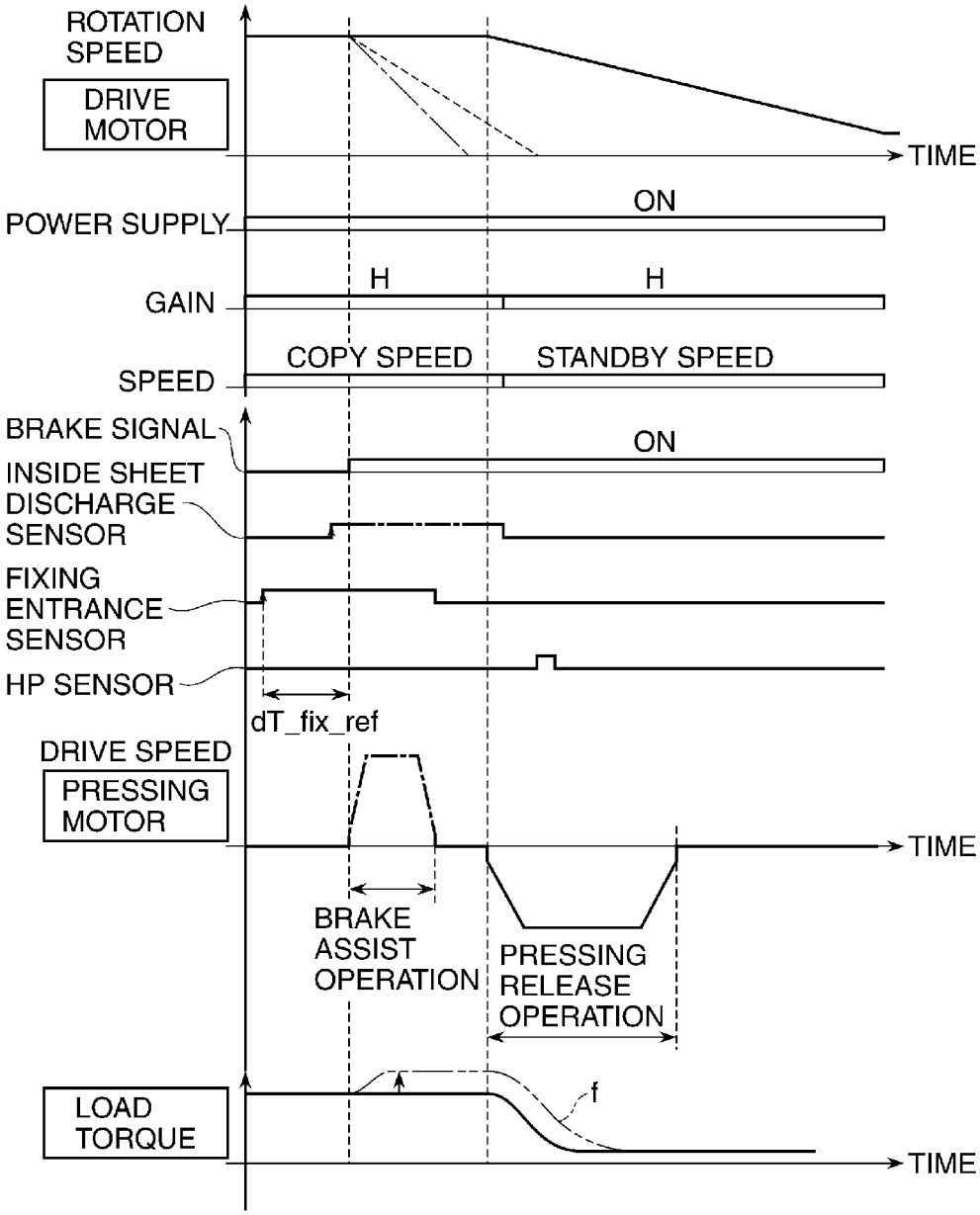
FIG. 9 is a timing chart showing a brake assist operation.

Next, a description will be given of a brake assist operation. FIG. 9 shows a brake assist operation in timing chart.

As previously described, the pressing amount in the fixing apparatus 12 can be adjusted by the pressing unit 31. As shown in FIG. 8, the pressing amount is in proportion to the amount of displacement of the pressing unit 31 caused by the rotation of the pressing motor 102.

The pressing amount is also in proportion to a friction torque generated in the nip portion where the fixing belt is in contact with the pressing belt. In other words, the execution of control for increasing or decreasing the pressing amount is equivalent to perform control for increasing or decreasing a load torque applied to the drive motor.

An energy amount (rotational energy E) accumulated during the rotation of the drive motor 110 is represented by formula (2).

$$E=\frac{1}{2}\cdot J\cdot\omega^2 \quad (2)$$

In formula (2), J ($kgm^2$) denotes the sum of the moment of inertia of motor rotor and the product of the moment of inertia of load system and the square of reduction ratio, and ω denotes angular velocity (rad/s).

Assuming that the rotational energy is consumed only by load torque TL until the drive motor stops, the drive amount (drive angle θ) until the motor stop is represented by formula (3).

$$\theta=E/TL \quad (3)$$

From the relation represented by formula (3) and the previously described fact that pressing amount is equivalent to load torque applied to the drive motor, it is understood that load torque can be controlled by controlling the pressing amount and a stop time can be controlled.

Figure 10:
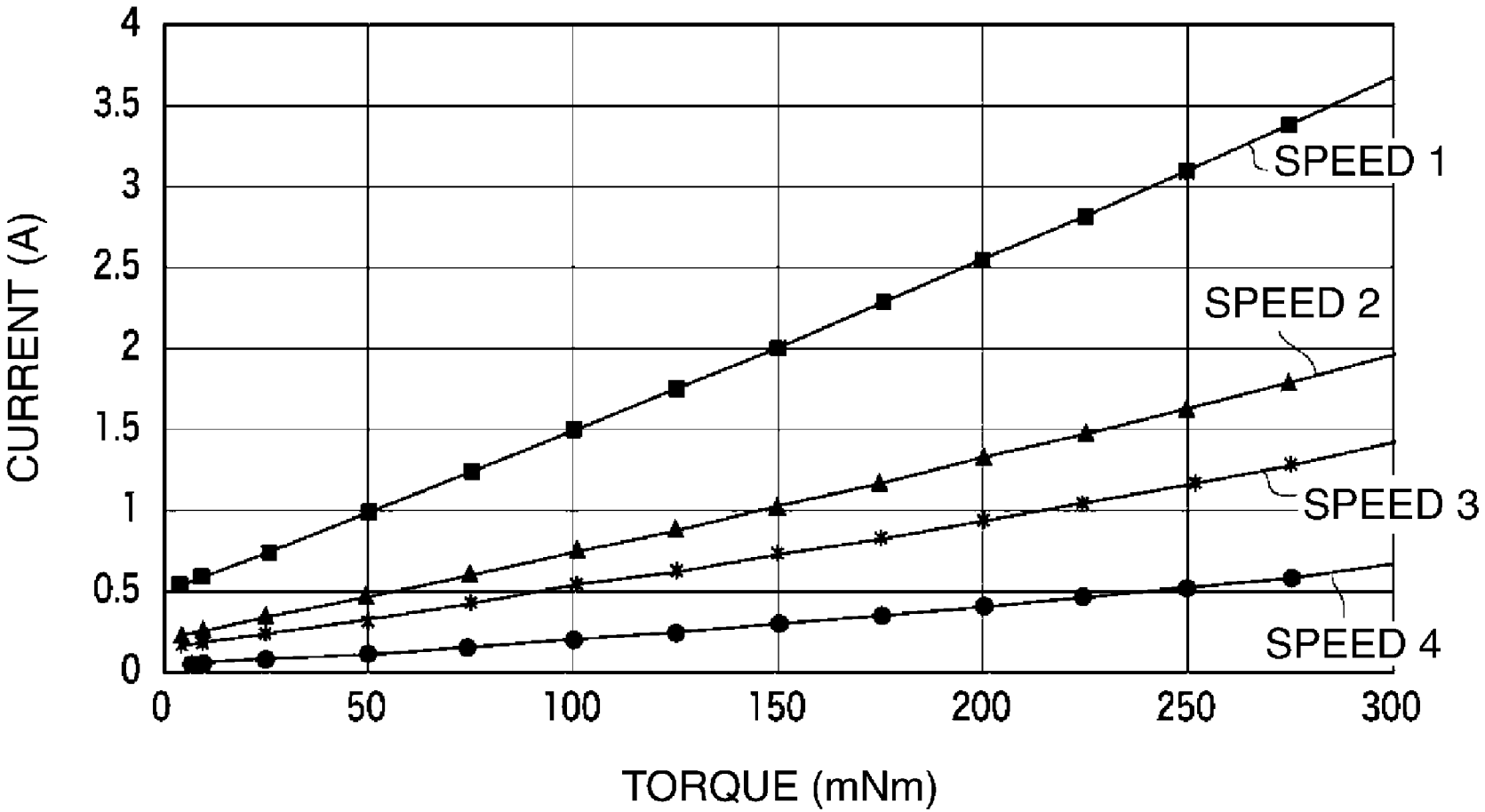
FIG. 10 is a graph showing a relation between input current of the drive motor and load torque.

FIG. 10 is a graph showing a relation between input current of the drive motor and load torque at each of four motor rotation speeds (speed 1>speed 2>speed 3>speed 4). As shown in FIG. 10, the motor input current is in proportion to the load torque at each of the speeds 1-4. The motor input current and the load torque are each in proportion to the motor rotation speed. Thus, the load torque can be detected by monitoring the input current of the drive motor (load torque detection unit).

It is also possible to calculate the required load torque at a given motor rotation speed by specifying a motor drive amount until the motor stops. If the detected load torque satisfies the requisite stop drive amount, it can be determined that the execution of torque control is unnecessary.

In the following, a description will be given of brake assist control which is performed by increasing the pressing amount at occurrence of a fixing wrap jam.

As shown in FIG. 2, a fixing entrance sensor 51 and an inside sheet discharge sensor 52 are disposed at the entrance and exit of the fixing apparatus 12. Whether or not a fixing wrap has occurred is determined based on a conveyance time which is decided by a distance between the sensors and a recording sheet conveyance speed.

In a case that a conveyance timing is detected based on abutment of a recording sheet against a mechanical flag disposed at the entrance of the fixing apparatus 12, a detection failure sometimes occurs due to, e.g., the floating of the recording sheet. To obviate this, in this embodiment, the conveyance timing is detected in reference to a registration ON timing, which is also used as a conveyance start reference.

Figure 11:
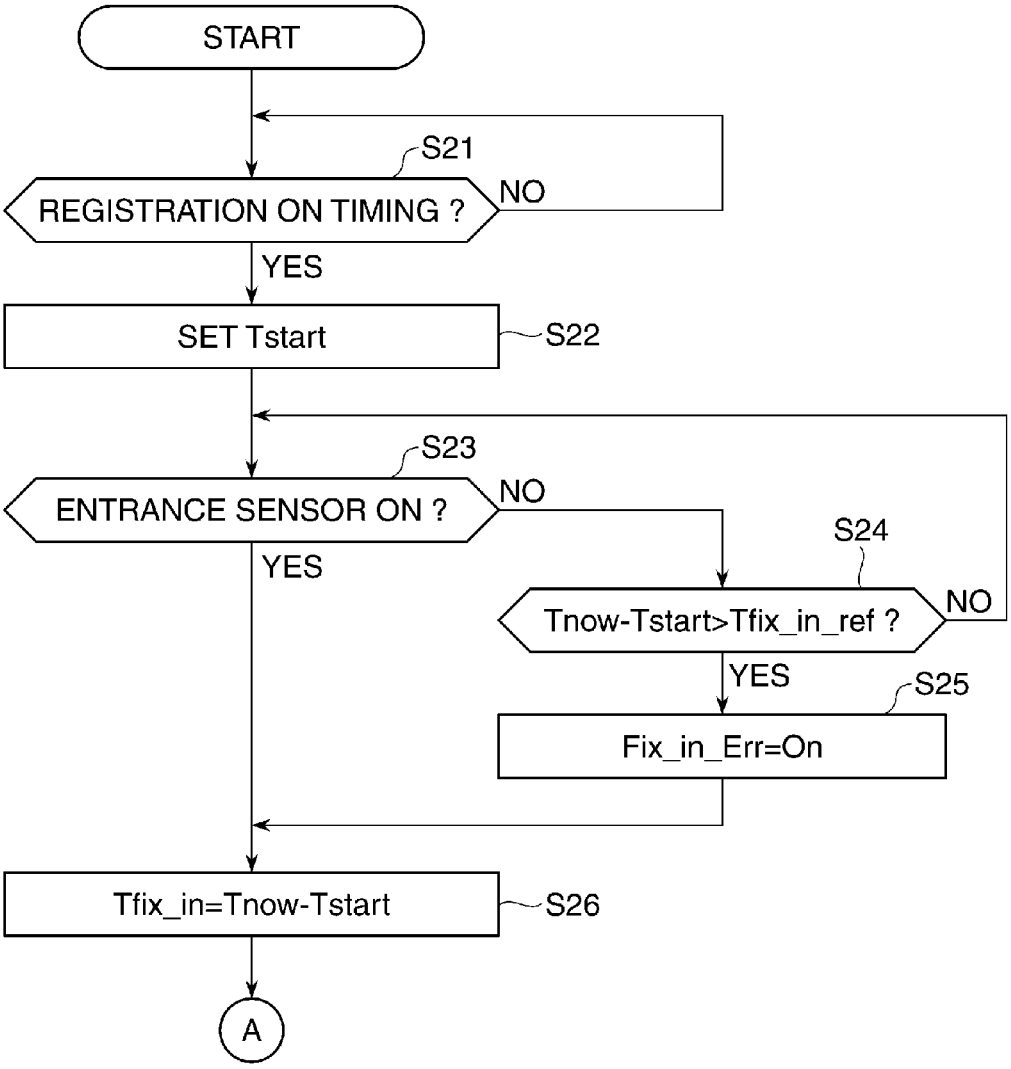
FIG. 11 is a flowchart showing a part of the procedures of a wrap jam detection process.
Figure 12:
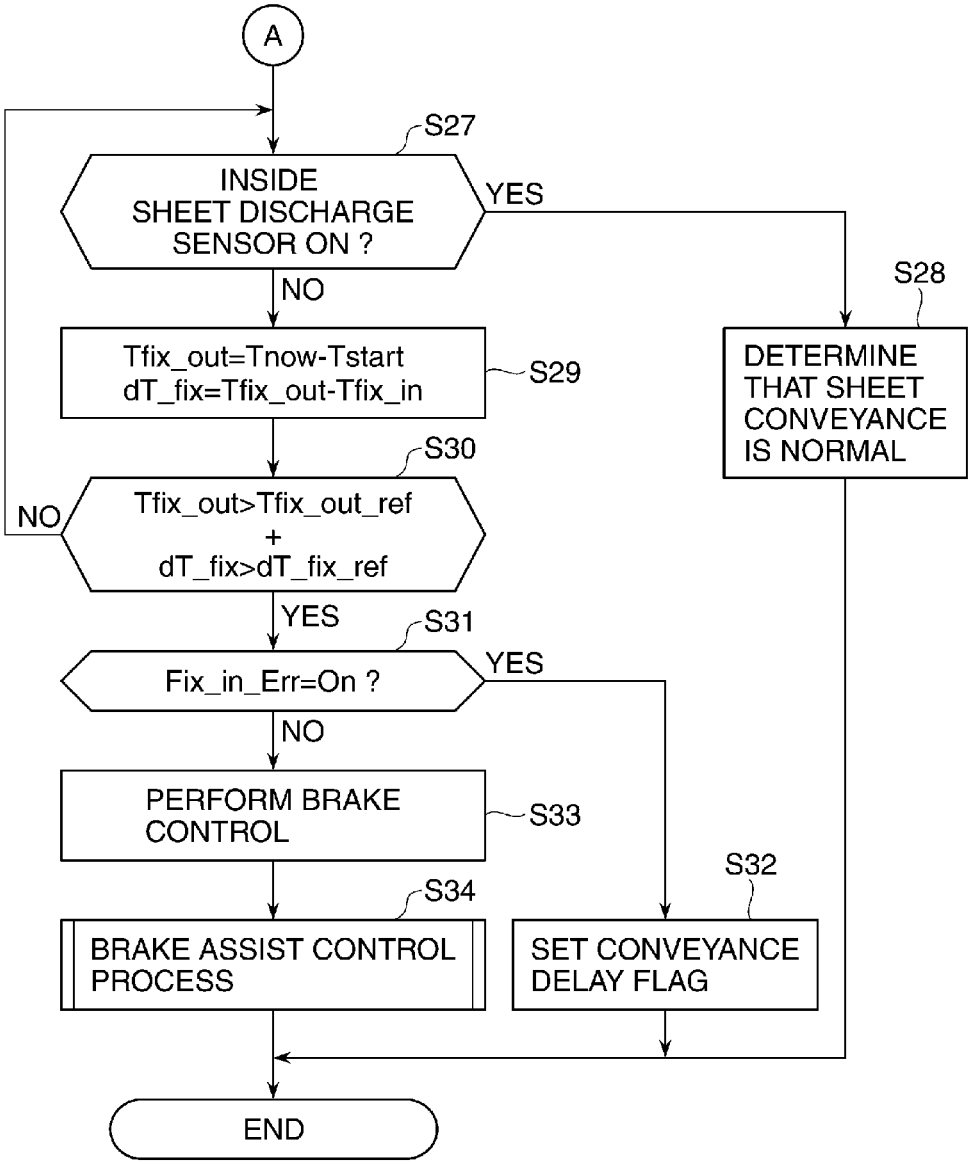
FIG. 12 is a flowchart showing the remaining part of the procedures of the wrap jam detection process that follows the part shown in FIG. 11.

FIGS. 11 and 12 show in flowchart the procedures of a wrap jam detection process. A process program therefor is stored in a storage device of the CPU 100 and executed by the CPU 100. After start of a copying operation, the CPU 100 waits until a registration ON timing as a reference for sheet conveyance is detected (step S21).

When detecting a registration ON timing, the CPU 100 sets, as a delay judgment reference, a start reference time Tstart according to a reference timer counter value, which is used for controlling the operation of the image forming apparatus (step S22). Next, the CPU 100 monitors whether the fixing entrance sensor 51 is made ON (step S23).

While monitoring the ON/OFF state of the fixing entrance sensor 51, the CPU 100 measures an elapsed time from the start reference time Tstart by subtracting the start reference time Tstart from a current time Tnow, and determines whether the elapsed time exceeds a predetermined arrival time "Tfix_in_ref" of recording sheet to the fixing entrance sensor 51 (step S24).

If the elapsed time does not exceed the predetermined arrival time "Tfix_in_ref," the flow returns to step S23.

On the other hand, if it is determined in step S24 that the elapsed time exceeds the predetermined arrival time "Tfix_in_ref," the CPU 100 determines that no sheet has been detected by the entrance sensor and sets an error flag "Fix_in_err" to be ON (step S25), whereupon the flow proceeds to step S26.

If it is determined in step S23 that the fixing entrance sensor 51 is made ON, the CPU 100 measures an arrival time "Tfix_in" of recording sheet to the fixing entrance sensor 51 by subtracting the start reference time Tstart from the current time Tnow, and records the arrival time "Tfix_in" (step S26).

Next, the CPU 100 determines whether the inside sheet discharge sensor 52 is made ON, thereby monitoring the recording sheet conveyance timing (step S27). If the inside sheet discharge sensor 52 is made ON, i.e., if it is determined that the arrival of recording sheet is detected before lapse of the predetermined time, the CPU 100 determines that the sheet conveyance is normal (step S28), whereupon the present process is completed.

On the other hand, if the inside sheet discharge sensor 52 is not made ON, the CPU 100 performs a time measurement, while monitoring the inside sheet discharge sensor 52 (step S29). In the time measurement, the elapsed time "Tfix_out" (=Tnow−Tstart) from the start reference time Tstart and the elapsed time "dT_fix" (="Tfix_out"−"Tfix_in") from the arrival time of recording sheet to the fixing entrance sensor are measured.

The CPU 100 determines whether the measured time "Tfix_out" is longer than the predetermined time "Tfix_out_ref" and the measured time "dT_fix" is longer than the predetermined time "dT_fix_ref" (step S30).

If the answer to step S30 is NO, the flow returns to step S27.

On the other hand, if the answer to step S30 is YES, the CPU 100 determines whether the error flag "Fix_in_err" for the fixing entrance sensor 51 is at ON. If the error flag "Fix_in_err" is at ON, the CPU 100 determines whether the fixing entrance sensor 51 is currently at ON (step S31). If the answer to step S31 is YES, the CPU 100 sets a flag representing a conveyance delay (step S32), whereupon the present process is completed.

On the other hand, if it is determined in step S31 that there is no conveyance delay, the CPU 100 determines that a wrap has occurred and performs brake control for the drive motor 110 (step S33) and performs a brake assist control process (step S34), whereupon the present process is completed. It should be noted that the processing in steps S30 and S31 is an example of a conveyance delay detection unit, and the processing in steps S33 and S34 is an example of a brake control unit.

Figure 13:
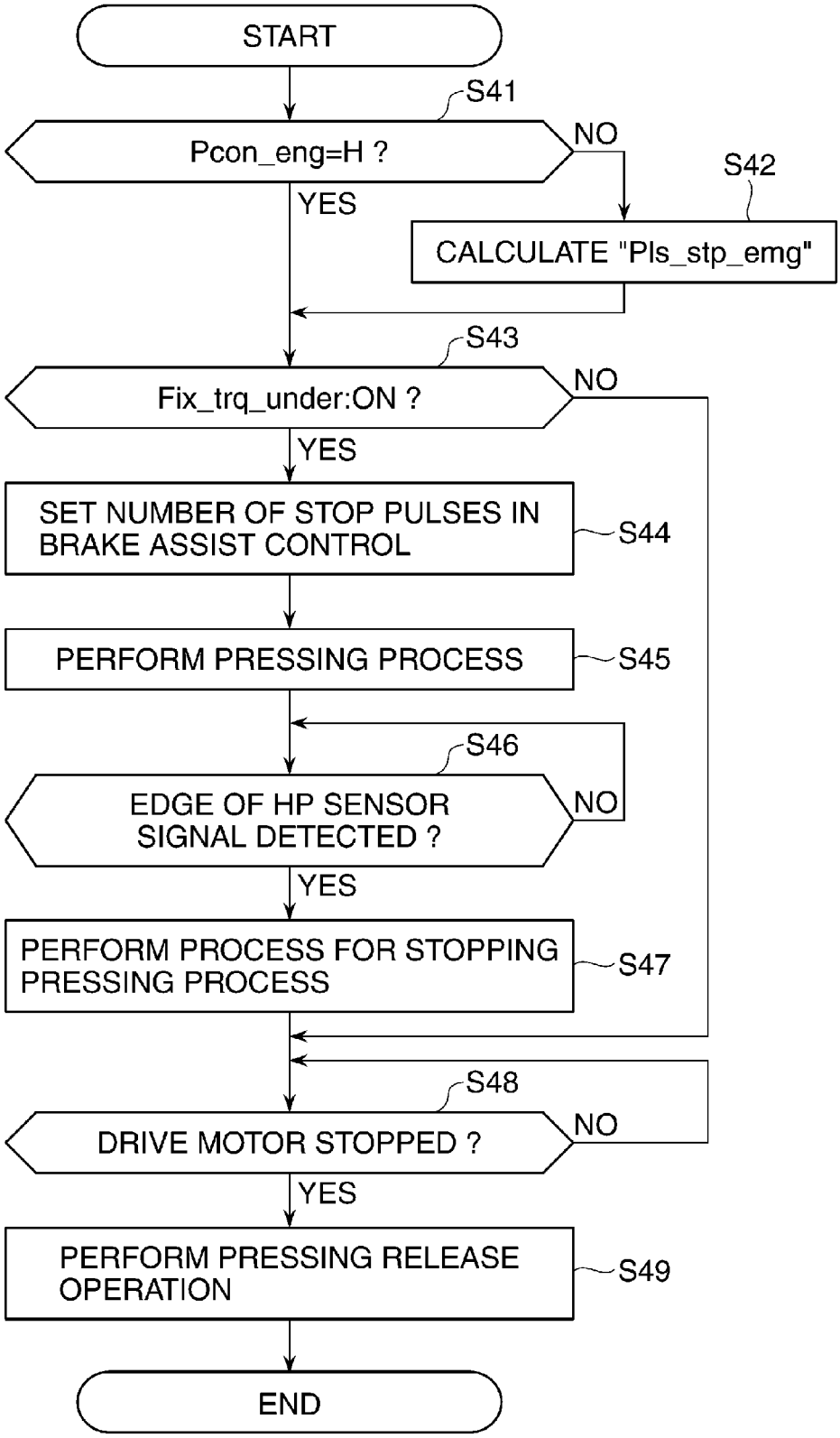
FIG. 13 is a flowchart showing the procedures of a brake assist control process in step S34 in FIG. 12.

FIG. 13 shows in flowchart the procedures of the brake assist control process in step S34 in FIG. 12. When an occurrence of wrap is detected and the process is called, the CPU 100 determines whether the register value "Pcon_eng" is at an H level so that the fixing apparatus is in the pressing adjustment mode (step S41).

If the fixing apparatus is not in the pressing adjustment mode, the CPU 100 calculates the number of brake assist pulses (the number of stop pulses for the pressing amount readjustment) "Pls_stp_emg" by subtracting the reference number of stop pulses "Pls_stp_ref" from the maximum number of stop pulses "Pls_stp_max" according to formula (1) (step S42), whereupon the flow proceeds to step S43.

On the other hand, if it is determined in step S41 that the fixing apparatus is in the pressing adjustment mode, the flow proceeds to step S43.

In step S43, based on a torque check register value "Fix_trq_under," which is made ON when the motor current equal to or less than a predetermined current value is detected so that the load torque is determined to be equal to or less than a predetermined value, the CPU 100 determines whether the brake assist control can be made. It should be noted that the torque is always checked in another task (not shown) based on the electric current detected by the motor current detection circuit 111 and based on the characteristic that the drive current of the drive motor 110 is in proportion to load torque.

If the torque check register value "Fix_trq_under" is at OFF so that the brake assist operation is unnecessary, the CPU 100 waits until confirming that the drive motor 110 stops (step S48). When confirming the drive motor 110 stops, the CPU 100 performs a pressing release operation (step S49), thereby making it easy to remove a recording sheet wrapped around a component of the fixing apparatus 12, whereupon the present process is completed.

On the other hand, if it is determined in step S43 that the brake assist control can be made, the CPU 100 sets, as the number of stop pulses in the brake assist control, the number of brake assist pulses "Pls_stp_emg" which has been set in step S13 in the pressing adjustment operation or has been set in step S42 (step S44).

Based on the number of stop pulses "Pis_stp_emg" set in step S44, the CPU 100 carries out the pressing process for brake assist (step S45). The pressing process for brake assist is the same as the previously described pressing process except for the number of stop pulses.

Next, the CPU 100 determines whether the edge of the HP sensor signal is detected (step S46), and carries out a process for stopping the pressing process when determining that the edge is detected (step S47).

As a result, the pressing amount increases such that the pressing unit 21 assumes the maximum pressing position shown in FIG. 8, and the load torque applied to the drive motor 110 increases, as shown by symbol f in FIG. 9, in proportion to the pressing amount.

Thus, an operation for braking the drive motor 110 is performed and a brake assist operation by the pressing motor 102 is performed without delay when an occurrence of a fixing wrap is detected.

Next, the CPU 100 determines based on a motor rotation detection signal whether the motor rotation is stopped or determines whether the required time for stopping the motor rotation has lapsed, thereby determining whether the drive motor 110 stops rotating (step S48). When determining that the drive motor 110 stops rotating, the CPU 100 performs a pressing release process to return the pressing unit 21 to the standby state so that the recording sheet wrapped around a component of the fixing apparatus 12 can easily be removed (step S49), whereupon the present process is completed.

In this embodiment, a brushless DC motor which is high in speed and output is used as the drive motor. Since such motor has a characteristic that motor drive current is in proportion to load torque (see, FIG. 10), the load torque is determined based on a motor current value as previously described. It should be noted that if a torque change is mainly caused by time-dependent degradation of the fixing apparatus (especially of the motor), operating hours of the fixing apparatus can be used as a criterion for load torque judgment.

In the embodiment, the number of pulses required for moving the pressing unit 21 to the maximum pressing position shown in FIG. 8 is calculated to set the number of brake assist pulses. Alternatively, the number of brake assist pulses can be set based on a load torque calculated from an amount of electric current supplied to the drive motor 110, which is detected by the motor current detection circuit 111.

According to the image forming apparatus of this invention, a brake assist operation by which the recording sheet can be stopped at a position where the sheet is sufficiently visible can be carried out even by using a low-priced short brake method which does not affect the required performance (e.g., withstand voltages) of circuit components.

Specifically, during the image formation on any type of recording sheet, it is possible to make a stop operation by which a recording sheet is positively stopped at a position where the sheet is visible when an occurrence of a wrap jam in the fixing apparatus is detected based on a load torque applied to the drive motor.

Since the position of the pressing roller is changed according to a difference between the pressing roller position and the maximum pressing position, an accurate brake assist operation can be performed. Since the pressing roller position is changed according to a detected load torque, a brake assist operation suited to load torque can be carried out.

If the load torque becomes to have a value equal to or greater than a predetermined value due to time-dependent degradation of the load system, the brake assist operation becomes unnecessary and is not performed. It is therefore possible to prevent stress from being applied to the belt supported by the fixing roller (i.e., to prevent the radius of curvature of the belt from being changed), whereby a reduction in service life of the belt can be suppressed.

The necessity of brake assist can be determined according to operating hours of the fixing apparatus. For example, the brake assist may not be performed when the operating hours of the fixing apparatus become equal to or larger than a predetermined value, whereas the brake assist may be performed, if the operating hours are less than the predetermined value, thus making it unnecessary to detect the load torque. A reduction of service life of the belt can be suppressed also in that case.

Image forming apparatuses to which the fixing apparatus of this invention is applied include an electrophotographic image forming apparatus and electrostatic recording image forming apparatus. As such image forming apparatuses, there may be mentioned a printing apparatus, a facsimile machine having a printing function, and a multi-function peripheral having a printing function, copy function, scanner function, etc.

Although a color image forming apparatus has been described in the embodiment, as an electrophotographic image forming apparatus, this invention is also applicable to a monochrome image forming apparatus.

It is also possible to modify shapes and relative locations of component parts described in the embodiment according to the construction of an apparatus to which this invention is applied and according to conditions under which the apparatus operates.

The recording sheet is not limitative in material and in shape and may be paper medium, OHP sheet, heavy sheet, tab sheet, or the like.

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2009-243204, filed Oct. 22, 2009, which is hereby incorporated by reference herein in its entirety.

What is claimed is:

1. A fixing apparatus that conveys a sheet formed with an image to a nip portion and fixes the image onto the sheet at the nip portion, the nip portion being formed by a roller driven by a motor and a pressing device for being pressed against the roller, comprising:

a conveyance abnormality detection unit configured to detect a sheet conveyance abnormality in the nip portion; and a brake control unit configured to brake the motor and increase a pressing amount of the pressing device so as to assist braking of the motor in a case where a sheet conveyance abnormality is detected.

2. The fixing apparatus according to claim 1, wherein in a case where a sheet conveyance abnormality in the nip portion is detected, said brake control unit changes a position of the pressing device based on a difference between the position of the pressing device and a predetermined pressing position so as to control the pressing amount.

3. The fixing apparatus according to claim 2, including:

a motor current detection unit configured to detect a current of the motor; and a load torque detection unit configured to detect a load torque based on the current detected by said motor current detection unit, wherein said brake control unit changes the position of the pressing device according to the load torque detected by said load torque detection unit.

4. The fixing apparatus according to claim 3, wherein said brake control unit increases the pressing amount in a case where the load torque detected by said load torque detection unit is equal to or less than a predetermined value, and does not increase the pressing amount in a case where the load torque detected by said load torque detection unit exceeds the predetermined value.

5. The fixing apparatus according to claim 1, wherein said brake control unit increases the pressing amount in a case where operating time of the fixing apparatus is less than a predetermined value, and does not increase the pressing amount in a case where the operating time of the fixing apparatus is equal to or greater than the predetermined value.

6. The fixing apparatus according to claim 1, wherein said conveyance abnormality detection unit detects a sheet conveyance abnormality in a case where a sensor disposed upstream of the nip portion detects, at a first timing, a sheet conveyed to the nip portion and a sensor disposed downstream of the nip portion does not detect, at a second timing, the sheet conveyed from the nip portion.

7. A fixing apparatus that conveys a sheet formed with an image to a nip portion and fixes the image onto the sheet at the nip portion, the nip portion being formed by a roller driven by a motor and a pressing device for being pressed against the roller, comprising:

a detection unit configured to detect that a sheet is wrapped around the roller; and a brake control unit configured to brake the motor and increase a pressing amount of the pressing device so as to assist braking of the motor in a case where said detection unit detects that a sheet is wrapped around the roller.

* * * * *